United States Patent [19]

May

[11] Patent Number: 4,652,245

[45] Date of Patent: Mar. 24, 1987

[54] SHALLOW DRAFT BOAT

[76] Inventor: Billy D. May, 213 8th St., Port St. Joe, Fla. 32456

[21] Appl. No.: 822,937

[22] Filed: Jan. 27, 1986

Related U.S. Application Data

[63] Continuation of Ser. No. 629,087, Jul. 9, 1984, abandoned.

[51] Int. Cl.[4] ..... G63H 5/16

[52] U.S. Cl. ..... 440/69; 114/288

[58] Field of Search ..... 114/62, 148, 151, 271, 114/277, 288, 289, 290, 291; 440/38, 66, 68–70

[56] References Cited

U.S. PATENT DOCUMENTS

| | | | |
|---|---|---|---|
| 815,187 | 3/1906 | Manker | 114/288 |
| 872,389 | 12/1907 | Terrell | 114/288 |
| 1,263,052 | 4/1918 | Fowler | 440/70 |
| 1,712,281 | 5/1929 | Royer | 114/288 |
| 2,269,801 | 1/1942 | Willrich | 114/288 |
| 2,344,619 | 3/1944 | Lake | 114/288 |
| 2,844,120 | 7/1958 | Nelson | 114/288 |
| 3,040,697 | 6/1962 | Federico et al. | 440/69 |
| 3,469,549 | 9/1969 | Rae | 114/288 |
| 3,548,428 | 12/1970 | Eades | 114/346 |
| 3,636,906 | 1/1972 | Wray | 114/288 |
| 3,648,640 | 3/1972 | Granger | 114/288 |
| 3,718,111 | 2/1973 | Vecchio | 114/346 |
| 3,793,980 | 2/1974 | Sherman | 440/69 |

*Primary Examiner*—Galen Barefoot
*Assistant Examiner*—Jesûs D. Sotelo
*Attorney, Agent, or Firm*—Jones & Askew

[57] ABSTRACT

An improved shallow draft boat useful for coastal fishing or shrimping operations is provided which substantially reduces drag and thus power requirements, and is so maneuverable that the boat can actually be turned completely within its own length without spinning out. The boat includes an elongated hull having an amidships, funnel-shaped motor well along with an axial trough extending from the well to the boat fan-tail; the trough is preferably of decreasing cross-sectional area along its length so that prop wash created by the motor is forced through a progressively smaller volume, thus producing an uplifting force adjacent the boat's stern. Hence, the boat may pass through very shallow water (as little as about eight inches in depth), at full power inasmuch as the boat actually rides upon the motor prop and flattened stern areas of the hull with very little draft. The trough construction also facilitates turning by creating a wall of water which must be shifted right or left; this allows the bow to come around very quickly for easy handling in restricted areas.

6 Claims, 6 Drawing Figures

SHALLOW DRAFT BOAT

This application is a continuation of application Ser. No. 629,087, filed July 9, 1984, now abandoned.

BACKGROUND OF THE INVENTION

1. Field of the Invention

The present invention relates to boat hulls of the kind having a screw propeller located amidship and an open bottom channel or trough, and an arrangement to produce uplifting forces facilitating shallow draft travel and maneuverability with the boat.

2. Description of the Prior Art

Man has traversed the waterways and oceans of the world virtually since the dawn of recorded history. Such as been accomplished for a multitude of purposes, including fishing, commerce and travel; and in virtually all instances, boats of various types and constructions have been employed. As a consequence, the boat building art is extremely old and well developed.

The most typical example of small powered boats of this century include an elongated hull presenting a bow and a stern, along with a rotatable propeller positioned at the stern of the boat below the normal water line. The propeller is rotatable through the medium of a motor, which may be of the outboard or inboard type. While this type of boat is extremely common, it presents a number of problems. For example, all such conventional boats must operate in sufficient depth of water to prevent the propeller from scraping bottom. However, as the propeller is rotated at greater speeds, there is a tendency to lift the bow of the boat, thereby forcing the stern deeper into the water. Therefore, in shallow water boat operators must be careful not to unduly accelerate, else the propeller will strike bottom, possibly causing severe damage. As a consequence, operations in shallow water are severely restricted and considerable skill is needed to prevent untoward accidents.

It has been suggested in the past to mount boat propellers at various locations other than the stern; see for example U.S. Pat. Nos. 3,636,906, 2,269,801 and 872,389, which illustrate midship mounted boat motors.

Catamaran-type boats have also been provided which basically include a pair of hull sections separated by an open area. These boats are generally of rather limited utility, being used primarily as pleasure craft.

Other prior patents depicting various types of boat constructions include U.S. Pat. Nos. 815,187, 3,548,428, 2,844,120, 3,469,549, 2,344,619 and 3,648,640.

Despite the multitude of prior boat constructions, however, there remains a decided need in the art for a very shallow draft, highly maneuverable boat which can be used for pleasure or commercial purposes (e.g., fishing or shrimping), while nevertheless being relatively low in cost and simple in construction.

SUMMARY OF THE INVENTION

In my present invention I employ an elongated boat hull with an amidship well. The rearward portion of the well decreases in cross-sectional area in a plane perpendicular to the longitudinal axis of the hull, creating a funnel-shaped configuration. The rearward portion of the well communicates directly with an elongated trough extending from the stern to the well. Water disturbed by the propeller in the well is channeled through the funnel-shaped portion of the well into the trough. In my preferred embodiment, the trough decreases in cross-sectional area as the stern is approached. Water forced through the trough exerts an upward force on the hull due to the decreasing cross-sectional area.

Accordingly, this lift on the hull provides the boat with less draft, reducing power requirements and permitting operation in shallow water. In addition, the amidship-mounted propeller provides good weight distribution during operation and permits a small turning radius. These advantages can be enjoyed by commercial as well as recreational boat operators.

DESCRIPTION OF THE PREFERRED EMBODIMENT

Figure 1:
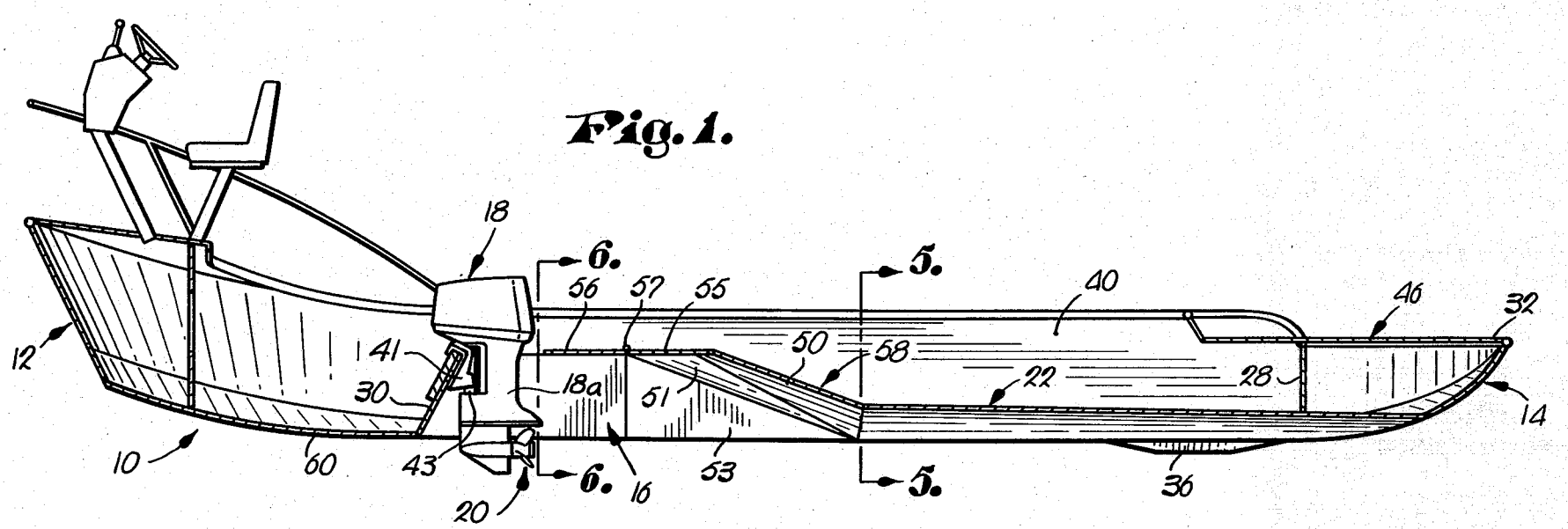
FIG. 1 is a vertical sectional view of a shallow draft boat made in accordance with the present invention.
Figure 2:
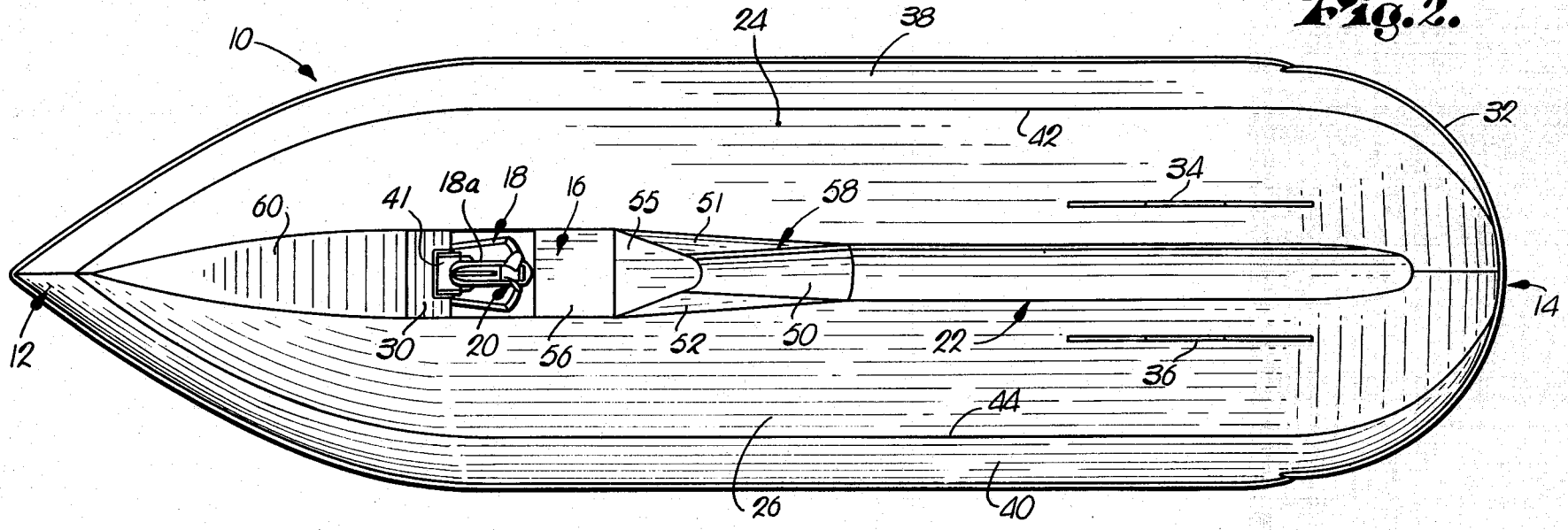
FIG. 2 is a bottom view thereof.
Figure 5:
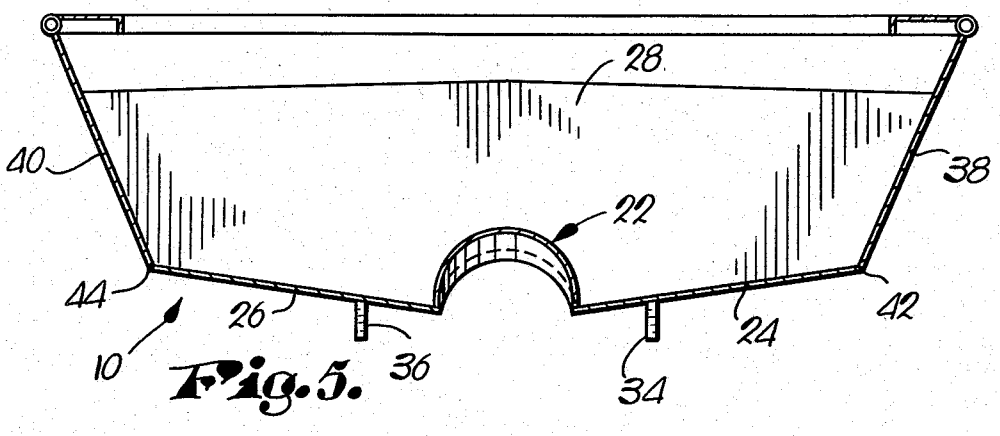
FIG. 5 is a cross-sectional view taken along line 5—5 of FIG. 1.
Figure 6:
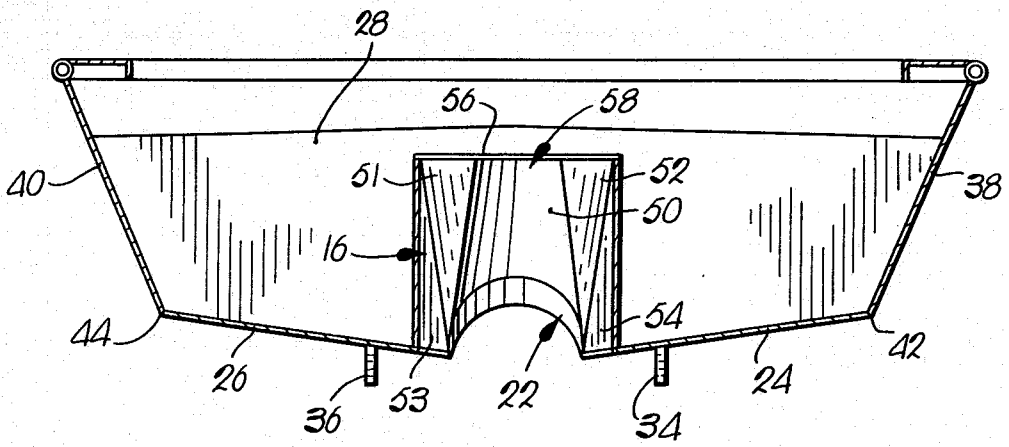
FIG. 6 is a cross-sectional view taken along line 6—6 of FIG. 1.
Figure 3:
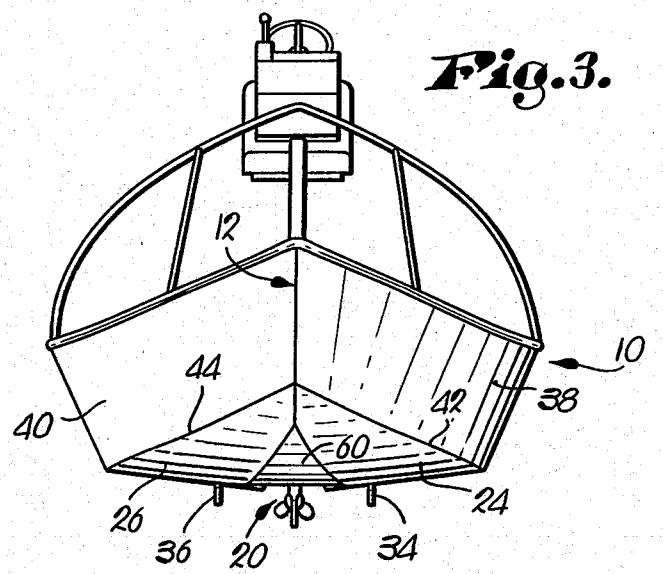
FIG. 3 is a front elevational view thereof.
Figure 4:
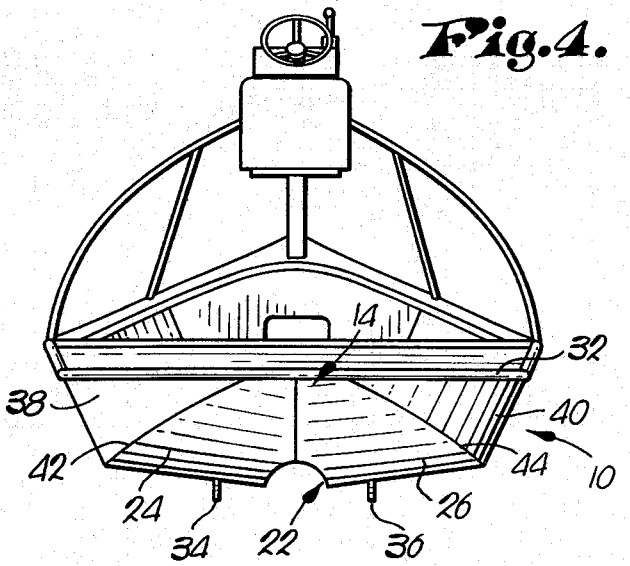
FIG. 4 is a rear elevational view thereof.

An elongated boat hull 10 has a bow 12 and a stern 14. Located between the bow 12 and the stern 14 is a funnel-shaped well 16 housing an engine 18 with a conventional thrust producing propeller 20. The well 16 is configured to channel water disturbed by the propeller 20 into an elongated trough 22. Water passing through trough 22 exits at the end of trough 22 located at the fantail or stern 14 of the boat hull 10.

Hull 10 includes two elongated bottom sections, 24 and 26, which are generally flat and substantially rectilinear in transverse crosssection. The sections 24, 26 are inclined upwardly from the central region of the hull toward the outside thereof in the area between a bulkhead 28 and a transom 30. The bottom sections 24 and 26 also curve gradually upwardly and inwardly forward of the transom 30 until they meet at the vertical centerline of the bow 12. The bottom sections 24 and 26 curve gradually upwards rearward of the bulkhead 28 until they meet a gunwale 32. Parallel skegs 34 and 36 are attached to the rear portion of bottom sections 24 and 26.

Hull 10 also includes two elongated side sections, 38 and 40, which are rectilinear in transverse cross-section and are inclined outwardly at the top thereof. The side sections 38 and 40 curve inward forwardly of the transom 30 until they meet at the vertical centerline of the bow 12. The side sections 38 and 40 curve inwardly rearwardly of the bulkhead 28 and terminate at the gunwale 32. The section 38 and the bottom 24 merge into a ridge line 42, and the section 40 and the bottom 26 merge into a ridge line 44. A top portion of the side sections 38 and 40 is removed to receive a deck 46.

The transom 30 is positioned transversely to hull 10 within the well 16 and inclined rearwardly at the upper edge. The transom 30 holds engine 18, shown as an outboard motor, although an inboard or an inboard/-outboard engine may also be utilized. As illustrated and as is usually the case with outboard motors, the motor 18 is supported on a conventional transom-mounted bracket 41, and the generally vertical body **18*a* of the motor is pivotal about upright shaft 43 engaging bracket 41; moreover, the bracket allows motor pivoting about a generally horizontal axis as well to provide a trim function. At least one-half of the vertical surface area presented by the propeller 20 is disposed below the bottom sections 24 and 26**.

The rearward portion of the well 16 includes an inclined curved piece 50, flat inclined triangular pieces 51 and 52, and flat vertical pieces 53 and 54 constructed and arranged to form a funnel 58. A stationary flat piece 55 is located across the top of the rearward portion of the well 16. The middle portion of the well 16 is provided with a movable flat top 56 mounted on a hinge 57, in order to facilitate access to the engine 18. Bottom piece 60 is forward of the well 16 and is configured to close the area bounded by the well 16 and the bottom sections 24 and 26.

The trough 22 rearward of the well 16 is arcuate in transverse cross-section, and is disposed along the central longitudinal axis between the bottom sections 24 and 26. As shown, the depth and width of the trough 22 decreases as the stern 14 is approached. The rearward end of the trough 22 is open where the trough 22 intersects with the stern 14.

In use, water disturbed by the propeller 20 is funneled through the rearward portion of the well 16 into the trough 22. As the water approaches the rearward portion of the trough 22 the reduced cross-sectional area of the trough 22 causes the water to exert an uplifting force near the stern 14. Also, during acceleration, the propeller 20 applies an upwardly force to an area near the bow 12. These two forces combine to lift the entire hull 10 while the latter remains essentially horizontal.

Due to upward forces, the draft of the hull 10 is considerably less than that of conventional boats. This reduced draft decreases the resistance to forward movement, which diminishes the power requirements to propeller 20. As a result, a smaller, lighter engine may be employed. Fuel consumption is also lessened, which permits smaller tanks holding less fuel. In turn, this decrease in both engine and fuel storage weight further reduces the draft of the boat.

My shallow draft boat may be operated in much shallower water than conventional boats. This advantage is particularly useful in the salt water bay areas, where tidal flats and sandbars are commonly encountered. Because more underwater obstacles are cleared, less accidental damage to the hull 10 and the propeller 20 will occur. The probability of higher-speed collisions with submerged objects is diminished, resulting in a much safer boat for the occupants.

Hull 10 also is more maneuverable than conventional boats. During turning, the walls of trough 22 present a resisting force, similar to the effect of a rudder or skeg. The bow 12 may freely move sideways because propeller 20 is disposed forward of the trough 22, while, simultaneously, the trough 22 opposes lateral movement in the rear portion of hull 10. As a result, hull 10 may be turned around in its own length at low speeds. At higher speeds, the boat will turn in a smaller radius than conventional boats without loss of steering control or propeller cavitation.

In addition, the hull 10 is particularly suitable for use as a fishing vessel. Since the hull 10 remains essentially horizontal while in motion, the occupants may more easily use a net or trawl. Because the engine 18 is mounted amidship, there are no entanglements with the propeller 20, allowing fish to be pulled closer to the boat. The propeller 20 may be left running as fish are pulled near the boat, as compared to conventional boats where the engine 18 must be turned off or shifted into neutral.

I claim:

1. A boat, comprising:

a hull having an elongated, generally horizontal bottom provided with a bow and a stern, said bottom, as said bow is approached, curving upwardly along a path lying in a vertical plane extending longitudinally of said bottom, said hull, as said bow is approached, also curving inwardly of said hull along a path lying in a horizontal plane extending longitudinally of said bottom;

structure defining an elongated, open-bottom well in the amidships region of the hull between said bow and stern, said structure including transom means positioned adjacent the bowmost end of the well and extending downwardly in an inclined orientation toward said bow;

means defining an elongated, forwardly opening, open-bottom trough in said bottom extending from said stern toward said bow, said trough having a height and width which both decrease as said stern is approached, said trough communicating with said well adjacent the sternmost end of the well; and propulsion means including an elongated, generally vertically oriented, propeller-supporting member operatively coupled with said transom means and situated at least partially within said well, and a thrust producing propeller coupled with said member, said propeller-supporting member being pivotal about an upright axis, said member also being pivotal about a generally horizontal axis for selectively directing the thrust of said propeller along either a horizontal, an upwardly inclined or a downwardly inclined axis, said propulsion means being located forwardly of said trough and within the forward one-half part of the length of said hull, said well-defining structure including wall means for accommodating said pivotal movement of said member and propeller, and for directing the wake left by the propeller in the water into the trough during forward movement of the boat through the water.

2. The invention of claim, 1 said well decreasing in cross-sectional area as the trough is approached and communicating at its rearmost extremity directly with the forward-most end of the trough.

3. The invention of claim 1, said trough having an essentially semi-circular, transverse, cross-sectional configuration throughout the length thereof.

4. The invention of claim 1, said trough being disposed in its entirety above the lower-most extremity of said bottom.

5. The invention of claim 1, said trough being disposed substantially along the central, longitudinal axis of said bottom.

6. The invention of claim 1, said bottom having opposed sections extending laterally and upwardly from the trough.

* * * * *